US005724688A

United States Patent [19]

Chen

[11] Patent Number: 5,724,688

[45] Date of Patent: *Mar. 10, 1998

[54] MULTIPURPOSE TOOL

[76] Inventor: Chin-Chuan Chen, 7F, No. 13, Lane 364, Sec. 1, Kee Lung Rd., Taipei, Taiwan

[ * ] Notice: The portion of the term of this patent subsequent to Aug. 2, 2014, has been disclaimed.

[21] Appl. No.: 284,827

[22] Filed: Aug. 2, 1994

[51] Int. Cl.[6] ..... B25B 7/22

[52] U.S. Cl. ..... 7/128; 7/107; 30/257; 81/418

[58] Field of Search ..... 7/107, 125–135, 7/157, 158; 30/229, 257; 81/418, 427

[56] References Cited

U.S. PATENT DOCUMENTS

| | | | |
|---|---|---|---|
| 1,853,356 | 4/1932 | Houck | 81/427 |
| 3,760,473 | 9/1973 | Studdard | 7/125 X |
| 3,947,905 | 4/1976 | Neff | 7/107 |
| 5,074,046 | 12/1991 | Kolesky | 30/257 X |
| 5,157,996 | 10/1992 | Keyvani | 30/257 X |

*Primary Examiner*—James G. Smith
*Attorney, Agent, or Firm*—Bucknam and Archer

[57] ABSTRACT

A multipurpose tools including two blades pivoted by a pivot, a torsional spring mounted around the pivot and having two opposite ends respectively fastened to either blade, and a limit plate pivotally fastened to one blade and releasably stopped against the other blade to limit the relative turning angle of the blades, the blades having a respective scissors portion at the front acted against each other to cut things, a respective V-cut at one side acted against each other to cut or strip electric wires, a respective serrated portion at an opposite side acted against each other to crimp things, and a respective handle at the rear end, each handle having folding tools and accessory storage chambers, one handle having a compass mounted on the end.

7 Claims, 2 Drawing Sheets

MULTIPURPOSE TOOL

BACKGROUND OF THE INVENTION

The present invention relates to hand tools, and relates more particularly to a multipurpose tool which combines a variety of hand tools into a pair of pliers.

Various hand tools have been disclosed, and have appeared on the market. These hand tools are commonly designed for a specific purpose. Therefore, different hand tools shall be prepared for different purposes. For example, an electrician must prepare a variety of hand tools including crimpers, strippers, cutting pliers, etc., while working. It is inconvenient and uncomfortable to carry a variety of hand tools around the body or in the pockets. Besides, the relative turning angle of the blades of regular cutting pliers is commonly over 90° angle, and therefore much effort will be wasted when operating a pliers to cut, crimp or process small things.

Furthermore, people are not all working indoors. Some people may have to work indoors as well as outdoors. While working outdoors, one may need to drink beverage or to each somethings. Therefore, a can opener or a pick-up device may be needed to open a can or to pick up foods.

SUMMARY OF THE INVENTION

The present invention has been accomplished under the circumstances in view. It is therefore the main object of the present invention to provide a pliers-like hand tool which can be used for multiple purposes.

According to the preferred embodiment of the present invention, the multipurpose tool is comprised of two pivoted blades having a pair of scissors at one end and a pair of insulative handles at an opposite end. A pair of V-cuts are made on the blades adjacent to the pair of scissors for cutting or stripping electric wires. A pair of crimpers are made on the blades adjacent to the handles and acted against each other to crimp things. A limit plate is pivotally fastened to one blade and releasably stopped against the other blade to limit the relative turning angle of the blades. Each handle comprises folding tools and accessory storage chambers. A compass is made on one handle. A corkscrew is fixedly fastened to one blade.

DETAILED DESCRIPTION OF THE PREFERRED EMBODIMENT

Figure 1:
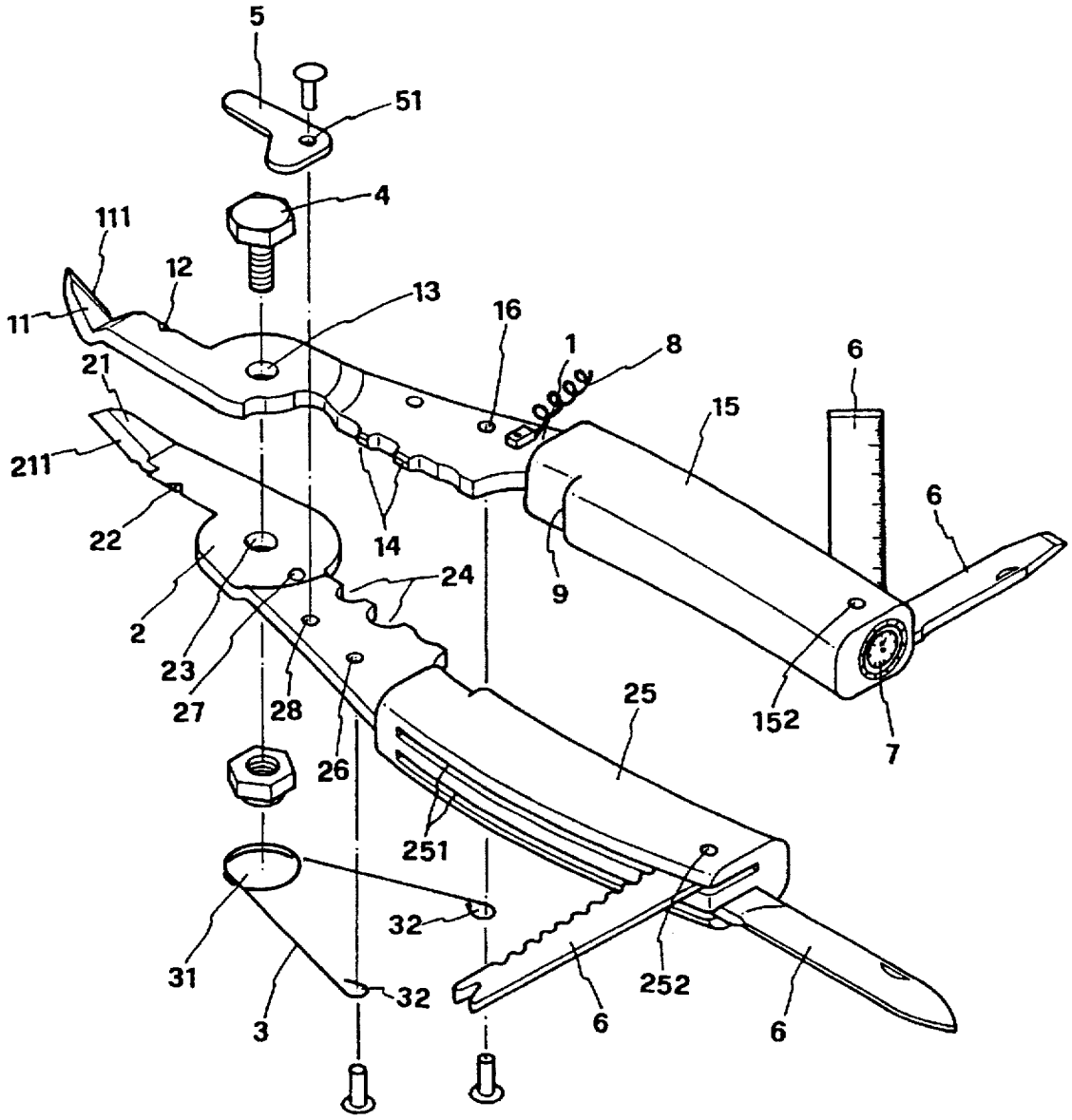
FIG. 1 is an exploded view of a multipurpose tool according to the preferred embodiment of the present invention.
Figure 2:
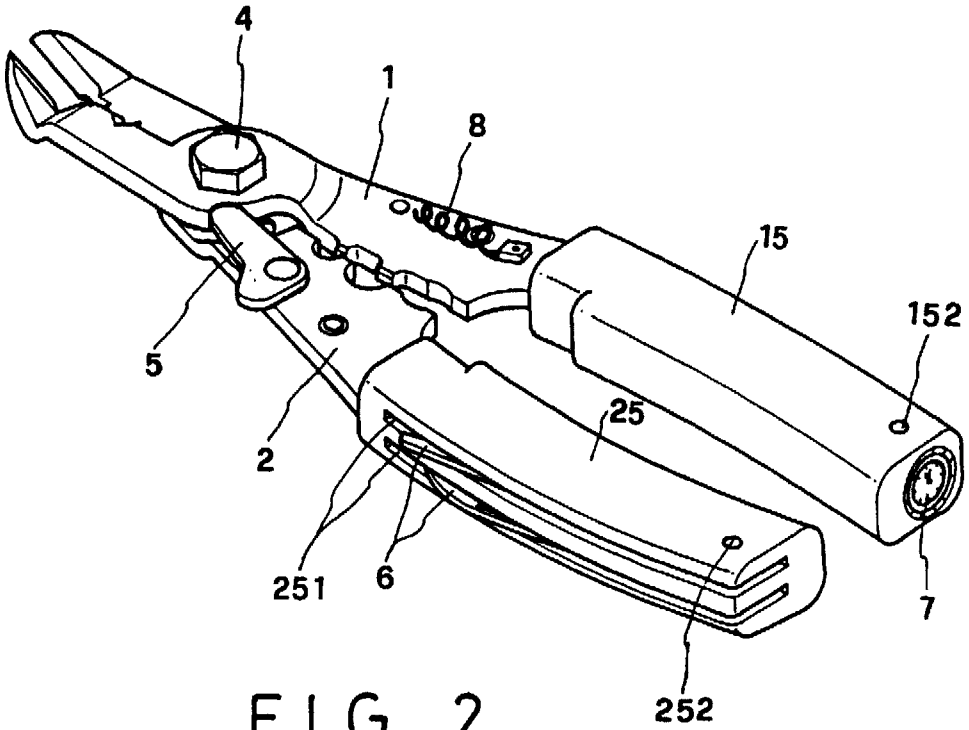
FIG. 2 is an elevational view of the multipurpose tool shown in FIG. 1.

Referring to FIGS. 1 and 2, a multipurpose tool in accordance with the present invention is generally comprised of a first blade 1, a second blade 2, a torsional spring 3, a pivot 4, and a limit plate 5.

The first and second blades 1 and 2 are symmetrical, having a respective pivot hole 13 or 23 pivotally connected together by the pivot 4. The front ends of the first and second blades 1 and 2 terminate in a respective upward scissors portion 11 or 21 with a respective cutting edge 111 or 211. The cutting edges 111 and 211 of the first and second blades 1 and 2 cut when come together. V-notches 12 and 22 are respectively made on the first and second blades 1 and 2 adjacent to the scissors portions 11 and 21 which work together to cut or strip electric wires. Serrated portions 14 and 24 are respectively longitudinally made on the first and second blades 1 and 2 at an inner side and moved to act against each other for crimping wires. The rear ends of the first and second blades 1 and 2 are fixedly fastened with a respective insulative handle 15 or 25. The handles 15 and 25 are smoothly curved inwards towards each other. Spring mounting holes 16 and 26 are respectively made on the first and second blades 1 and 2 between the handles 15 and 25 and the pivot holes 13 and 23 for mounting the torsional spring 3. The second blade 2 has a stub rod 27 adjacent to the pivot hole 23 which limits the turning angle of the first blade 1 relative to the second blade 2. The torsional spring 3 comprises a coiled middle portion 31 mounted around the pivot 4, two hooked ends 32 respectively fastened to the spring mounting holes 16 and 26. A through hole 28 is made on the second blade 2 between the spring mounting hole 26 and the stub rod 27 for mounting the limit plate 5. The limit plate 5 has a pivot hole 51 at one end pivotally connected to the through hole 28 by a pivot.

Referring to FIG. 2 again, when the limit plate 5 is turned into the operative position and stopped at the stub rod 27 against the first blade 1, the turning angle of the blades 1 and 2 is limited within a limited range.

Referring to FIGS. 1 and 2 again, the handle 15 or 25 comprises a plurality of longitudinal slots 151 (not shown) or 251 at an outer side, a pivot 152 or 252 through the longitudinal slots 151 or 251, and folding tools 6 such as rules, saw blades, screwdrivers, cutting blades, etc., turned about the pivot 152 or 152 and received in the longitudinal slots 151 or 251 respectively. The folding tools 6 in the handle 25 of the second blade 2 can be turned out of the respective longitudinal slots 251 through 180° angle. The folding tools 6 in the handle 15 of the first blade 1 can only be turned out of the respective longitudinal slots 151 within 90° angle.

Furthermore, a compass 7 is mounted on the end of the handle 15 of the first blade 1; a corkscrew 8 is fixedly fastened to the first blade 1 adjacent to the spring mounting hole 16 for drawing corks from bottles; a plurality of longitudinal storage chambers 9 are respectively made on each handle 15 and 25 for keeping small accessories.

What is claimed is:

1. A multipurpose tool comprising:

a first elongated, flat blade having a front end terminating in an upward scissors portion and a rear end fixedly fastened with a handle, a V-cut at one side adjacent to the upward scissors portion, a pivot hole between the upward scissors portion and the handle, a serrated portion longitudinally disposed at an opposite side adjacent to the handle, a spring mounting hole adjacent to the serrated portion;

a second elongated, flat blade having a front end terminating in an upward scissors portion moved to act against the upward scissors portion of said first elongated, flat blade and a rear end fixedly fastened with a handle, a V-cut at one side adjacent to the upward scissors portion of said second elongated, flat blade and acted against the V-cut on said first elongated, flat blade to cut or strip electric wires, a pivot hole between the upward scissors portion and handle of said second elongated, flat blade and pivotally connected to the pivot hole of said first elongated, flat blade, a serrated portion longitudinally disposed at an opposite side and acted against the serrated portion of said first elongated, flat blade to crimp things, a spring mounting hole adjacent to the serrated portion of said second elongated, flat blade;

a pivot fastened to the pivot holes on said first and second elongated, flat blades permitting said first and second elongated, flat blades to act as a pair of scissors;

a torsional spring mounted around said pivot between the pivot holes of said first and second elongated, flat blades, having two opposite ends respectively fastened to the spring mounting holes of said first and second elongated, flat blades; and a limit plate pivotally fastened to said second elongated, flat blade and releasably stopped against said first elongated, flat blade to limit the relative turning angle of said first and second elongated, flat blades.

2. The multipurpose tool of claim 1 wherein the upward scissors portions of said first and second elongated, flat blades have a respective cutting edge moved against each other to cut things.

3. The multipurpose tool of claim 1 wherein the handle of each elongated, flat blade comprises a plurality of longitudinal slots at an outer side, a pivot through said longitudinal slots, and a plurality of folding tools turned about the pivot on the respective handle and received in said longitudinal slots respectively.

4. The multipurpose tool of claim 1 wherein the longitudinal slots on the handle of either elongated, flat blade are extended to the end.

5. The multipurpose tool of claim 1 wherein the handle of either elongated, flat blade has a compass mounted on the end.

6. The multipurpose tool of claim 1 further comprising a corkscrew fixedly fastened to said first elongated, flat blade adjacent to the spring mounting hole on said first elongated, flat blade.

7. The multipurpose tool of claim 1 wherein the handle of either elongated, flat blade has a plurality of longitudinal storage chambers for keeping things.

* * * * *